US006098920A

United States Patent [19]

Wakihara

[11] Patent Number: 6,098,920

[45] Date of Patent: Aug. 8, 2000

[54] PAPER TRANSFER ASSISTING MECHANISM AND PAPER TRANSFER APPARATUS INCORPORATING THE SAME

[75] Inventor: Junji Wakihara, Kato-gun, Japan

[73] Assignee: Fujitsu Limited, Kawasaki, Japan

[21] Appl. No.: 09/162,769

[22] Filed: Sep. 30, 1998

[30] Foreign Application Priority Data

Apr. 24, 1998 [JP] Japan ..... 10-114525

[51] Int. Cl.[7] ..... B65H 23/26; G03G 15/00

[52] U.S. Cl. ..... 242/615.2; 399/375; 242/615.3

[58] Field of Search ..... 226/59, 108, 112, 226/189, 74; 242/615.2, 548.2, 615.3; 355/72, 75, 103, 108–111; 270/58.27; 399/17, 23, 375, 384; 400/613, 613.2, 619, 633, 633.1, 633.2; 271/253, 255; 101/228

[56] References Cited

U.S. PATENT DOCUMENTS

| | | | |
|---|---|---|---|
| 610,390 | 9/1898 | Felbel | 400/613 |
| 928,882 | 7/1909 | Pfunder | 400/633.2 |
| 1,566,441 | 12/1925 | Smothers | 226/189 |
| 1,927,612 | 9/1933 | Ostrey | 400/633.2 |
| 2,020,145 | 11/1935 | Jackson | 400/613.2 |
| 2,273,565 | 2/1942 | Euth et al. | 400/633.2 |
| 3,001,680 | 9/1961 | Nitkiewicz | 242/615.2 |
| 4,302,102 | 11/1981 | Stark et al. | 355/72 |
| 5,248,207 | 9/1993 | Yamamoto et al. | 400/613 |
| 5,713,071 | 1/1998 | Hausmann | 399/384 |
| 5,820,007 | 10/1998 | Crowley | 226/74 |

*Primary Examiner*—John M. Jillions
*Attorney, Agent, or Firm*—Armstrong, Westerman, Hattori, McLeland & Naughton

[57] ABSTRACT

A paper transfer assisting mechanism is provided for ensuring proper transfer of elongated paper along a transfer path. The elongated paper has a first longitudinal edge and a second longitudinal edge extending in parallel to the first longitudinal edge. The paper transfer assisting mechanism includes a paper guide plate arranged adjacent to the transfer path, a first rotatable guide roller brought into contact with the first longitudinal edge of the paper, and a second rotatable guide roller brought into contact with the second longitudinal edge of the paper. The first rotatable guide roller is positionally fixed to the paper guide plate, whereas the second rotatable guide roller is adjustable in position with respect to the paper guide plate. To this end, the second guide roller is carried by a carriage which is slidably supported by a guide rod extending transversely of the transfer path.

15 Claims, 9 Drawing Sheets

PAPER TRANSFER ASSISTING MECHANISM AND PAPER TRANSFER APPARATUS INCORPORATING THE SAME

BACKGROUND OF THE INVENTION

1. Field of the Invention

The present invention relates to a paper transfer assisting mechanism for ensuring that elongated paper is properly fed and transferred along a predetermined transfer path. The present invention also relates to a paper transfer apparatus incorporating such a paper transfer assisting mechanism.

2. Description of the Related Art

Conventionally, use has been made of e.g. an electrophotographic apparatus for printing selected images on elongated recording paper. Typically, the elongated paper may be divided into a series of continuous recording segments defined by plural lines of perforations formed in the elongated paper. Recently, in order to meet the needs for more effective printing operation, such elongated paper may need to be transferred at high speed (1,000 mm/s for example).

For transferring the elongated paper along a predetermined path, an electrophotographic apparatus may incorporate a paper transfer mechanism. The high-speed paper transfer may be possible by improving the paper transfer mechanism.

A conventional paper transfer mechanism may include a paper guide plate arranged along the transfer path for guiding the recording paper, and a traction mechanism for moving the recording paper along the transfer path. The traction mechanism may be arranged adjacent to an image transfer processing section of the electrophotographic apparatus. The traction mechanism may be provided with a plurality of movable engaging projections or claws coming into engagement with feed holes of the recording paper. The feed holes are arranged in two rows each extending along a corresponding one of the longitudinal edges of the recording paper. When the paper transfer mechanism is actuated, with the engaging claws held in engagement with the feed holes, the recording paper is advanced along the transfer path. In addition to the traction mechanism, the paper transfer mechanism may include a paper feed roller for feeding the recording paper from a paper feeding section into the transfer path. The paper feed roller may be arranged adjacent to the paper feeding section. Further, the paper transfer mechanism may include a paper container to be placed at the paper feeding section. The paper container is arranged to hold the recording paper in a neatly folded manner.

With such an arrangement, upon rotation of the paper feed roller, the elongated paper accommodated in the paper container is led onto the transfer path. Thereafter, while properly guided by the paper guide plate, the elongated paper is forwarded further along the transfer path. After passing by the paper guide plate, the recording paper is moved forward by the traction mechanism. As previously described, the traction mechanism includes movable claws coming into engagement with the feed holes arranged along the longitudinal edges of the elongated paper. Thus, when the elongated paper is moved by the traction mechanism, the elongated paper will not deviate laterally (and longitudinally) from the transfer path. After passing by the traction mechanism, the recording paper may be brought to a terminal section arranged at the end of the transfer path. At the terminal section, like at the paper feeding section, the recording paper may be held in a neatly folded manner.

In the paper transfer mechanism having the above arrangements and functions, higher transfer speed of the recording paper may be attained by increasing the operation speeds of the traction mechanism and the paper feed roller. Here, by causing the operation speed of the paper feed roller to differ from that of the traction mechanism, the recording paper can be transferred properly (for example, without sagging).

Instead of using the elongated paper with feed holes, use may be made of elongated recording paper having no feed holes. In this case, suitable transfer rollers may be used in place of the traction mechanism described above.

The conventional paper transfer mechanism has been found disadvantageous in the following points.

First, in the conventional transfer mechanism, no means for preventing deviation of the paper is provided between the paper feeding section and the image transfer section. Thus, as transferred between the above sections, the elongated paper may unduly sway relative to the transfer path or take an oblique posture relative to the transfer path. Such an unfavorable transfer behavior of the recording paper may adversely affect the image forming performance onto the elongated paper at the image transfer section.

The above disadvantage may be addressed by providing e.g. guide plates on both sides of the transfer path. However, such guide plates may easily be worn out through contact with the recording paper transferred at high speed. As a result, guide plates may need to be replaced frequently, which is disadvantageous in terms of costs.

SUMMARY OF THE INVENTION

It is, therefore, an object of the present invention to provide a paper transfer assisting mechanism capable of overcoming the disadvantages described above.

Another object of the present invention is to provide a paper transfer apparatus incorporating such a paper transfer assisting mechanism.

According to a first aspect of the present invention, there is provided a paper transfer assisting mechanism for ensuring proper transfer of elongated paper moved along a transfer path, the elongated paper having a first longitudinal edge and a second longitudinal edge, the mechanism comprising:

- a paper guide plate arranged adjacent to the transfer path;
- a first rotatable guide roller brought into contact with the first longitudinal edge of the paper; and
- a second rotatable guide roller brought into contact with the second longitudinal edge of the paper.

With such an arrangement, it is possible to prevent the elongated paper from unduly deviating from the transfer path (for example, swaying widthwise of the transfer path), since the paper is flanked by the first and second guide rollers. Further, the first and second guide rollers are arranged to rotate. Thus, even when the two guide rollers are contacted by the elongated paper transferred at high speed, the guide rollers will hardly be worn out nor damaged since the rotation of the rollers can absorb the friction caused between the transferred paper and the guide rollers.

Preferably the guide rollers may comprise bearings, though such an arrangement is not limitative.

According to a preferred embodiment, the first rotatable guide roller may be positionally fixed to the paper guide plate, whereas the second rotatable guide roller may be adjustable in position with respect to the paper guide plate.

With such an arrangement, the paper transfer assisting mechanism can cope with various kinds of elongated papers differing in width, since the second guide roller is adjustable in position.

The paper transfer assisting mechanism may further comprise a guide rod extending transversely of the transfer path and a carriage slidably supported by the guide rod; wherein the second guide roller is supported by the carriage.

Preferably, the paper transfer assisting mechanism may further comprise a spring connected to the carriage, wherein the carriage is releasably fixed in position to the guide rod by an urging force of the spring.

According to another preferred embodiment, the paper transfer assisting mechanism may comprise an externally threaded rod extending transversely of the transfer path and an internally threaded member screwed on the externally threaded rod, wherein the second guide roller is connected to the internally threaded member.

With such an arrangement, when the externally threaded rod is manually rotated, the internally threaded member will be moved relative to the externally threaded rod. In this manner, the user can adjust the position of the second guide roller by suitably rotating the externally threaded rod.

Preferably, the paper transfer assisting mechanism may further comprise a third rotatable guide roller brought into contact with the first longitudinal edge of the paper and a fourth rotatable guide roller brought into contact with the second longitudinal edge of the paper, wherein the third guide roller is spaced from the first guide roller along the transfer path, the fourth guide roller being spaced from the second guide roller along the transfer path.

With such an arrangement, each of the first and second longitudinal edges of the paper comes into contact with plural guide rollers arranged at different positions along the transfer path. Thus, it is possible to mere reliably prevent the deviation of the paper transferred along the transfer path.

According to a second aspect of the present invention, there is provided a paper transfer assisting mechanism for ensuring proper transfer of elongated paper moved along a transfer path extending from a paper feeding section, the elongated paper having a first longitudinal edge and a second longitudinal edge, the mechanism comprising:

a paper container placed at the paper feeding section for holding the paper, the paper container being provided with a first side wall and a second side wall facing the first side wall, a distance between the first and the second side walls being substantially equal to a distance between the first and second longitudinal edges of the paper;

a first positioning member coming into contact with the first side wall of the paper container; and a second positioning member coming into contact with the second side wall of the paper container.

With such an arrangement, when the elongated paper is accommodated in the paper container, the first longitudinal edge of the paper is held in contact with the first side wall of the container while the second longitudinal edge is held in contact with the second side wall. Thus, even when the paper is continuously fed out from the container at high speed, the paper will not sway widthwise nor be transferred in an inclined posture with respect to the transfer path.

The paper container may comprise a box having an upward opening for allowing smooth feed of the elongated paper. In such an instance, the elongated paper may be accommodated by the box in a neatly folded manner. However, such an arrangement is not limitative, and the elongated paper may initially be rolled about a core.

Preferably, the first positioning member is fixed in position, whereas the second positioning member is adjustable in position with respect to the first positioning member.

With such an arrangement, the user can utilize various kinds of paper containers differing in size, and consequently various kinds of elongated paper having different widths.

According to a preferred embodiment, the paper transfer assisting mechanism may further comprise a slide rail for slidably supporting the second positioning member, and a spring associated with the slide rail for urging the second positioning member toward the first positioning member.

Preferably, the first positioning member is variable in posture. Specifically, the first positioning member may be pivotable about a horizontal axis so that the first positioning member is displaced downwardly when the paper container is brought into the paper feeding section.

The paper transfer assisting mechanism may further comprise a plurality of rotatable support rollers arranged at the paper feeding section for supporting the paper container.

With such an arrangement, by causing the paper container to slide over the support rollers, the user can easily install the paper container into the paper feeding section and take the container out of the feeding section.

According to a third aspect of the present invention, there is provided a paper transfer apparatus for transferring elongated paper provided with feed holes, the paper being transferred along a transfer path extending from a paper feeding section to a terminal section via a processing section, the paper transfer apparatus comprising:

a traction mechanism for transferring the paper along the transfer path, the traction mechanism being arranged at a predetermined location adjacent to the transfer path and provided with engaging claws coming into engagement with the feed holes of the paper;

a paper feed roller for feeding the paper from the paper feeding section, the paper feed roller being spaced from the traction mechanism along the transfer path toward the paper feeding section; and a paper transfer assisting mechanism arranged adjacent to the paper feed roller for ensuring proper transfer of the paper;

wherein the paper has a first longitudinal edge and a second longitudinal edge, the paper transfer assisting mechanism comprising: a paper guide plate arranged adjacent to the transfer path; a first rotatable guide roller brought into contact with the first longitudinal edge of the paper; and a second rotatable guide roller brought into contact with the second longitudinal edge of the paper.

The traction mechanism may be arranged adjacent to the processing section.

According to a fourth aspect of the present invention, there is provided a paper transfer apparatus for transferring elongated paper along a transfer path extending from a paper feeding section to a terminal section via a processing section, the paper transfer apparatus comprising:

a paper feed roller for feeding the paper from the paper feeding section;

a paper transfer roller for transferring the paper along the transfer path, the paper transfer roller being spaced from the paper feed roller along the transfer path toward the terminal section;

a first paper transfer assisting mechanism arranged adjacent to the paper feed roller; and a second paper transfer assisting mechanism arranged adjacent to the paper transfer roller;

wherein the paper has a first longitudinal edge and a second longitudinal edge, each of the first and second paper transfer assisting mechanisms comprising: a paper guide plate arranged adjacent to the transfer path; a rotatable guide roller brought into contact with the first longitudinal edge of the paper; and another rotatable guide roller brought into contact with the second longitudinal edge of the paper.

In the above arrangements, the elongated paper is not provided with feed holes, and a paper transfer roller is used instead of the traction mechanism.

Preferably, the paper transfer apparatus may further comprise an additional paper transfer assisting mechanism spaced from the processing section along the transfer path toward the terminal section, wherein the additional paper transfer assisting mechanism comprises a paper guide plate arranged adjacent to the transfer path, a first rotatable guide roller brought into contact with the first longitudinal edge of the paper and a second rotatable guide roller brought into contact with the second longitudinal edge of the paper.

Preferably, the paper transfer apparatus may further comprise: a paper container placed at the paper feeding section for holding the paper, the paper container being provided with a first side wall and a second side wall facing the first side wall, a distance between the first and the second side walls being substantially equal to a distance between the first and second longitudinal edges of the paper; a first positioning member coming into contact with the first side wall of the paper container; and a second positioning member coming into contact with the second side wall of the paper container.

In the paper transfer apparatus, the paper may be subjected to image transfer processing at the processing section.

Other features and advantages of the present invention should become clear from the detailed description to be made hereinafter referring to the accompanied drawings.

DETAILED DESCRIPTION OF THE PREFERRED EMBODIMENT

The preferred embodiments of the present invention will be specifically described below with reference to the accompanying drawings.

Figure 1:
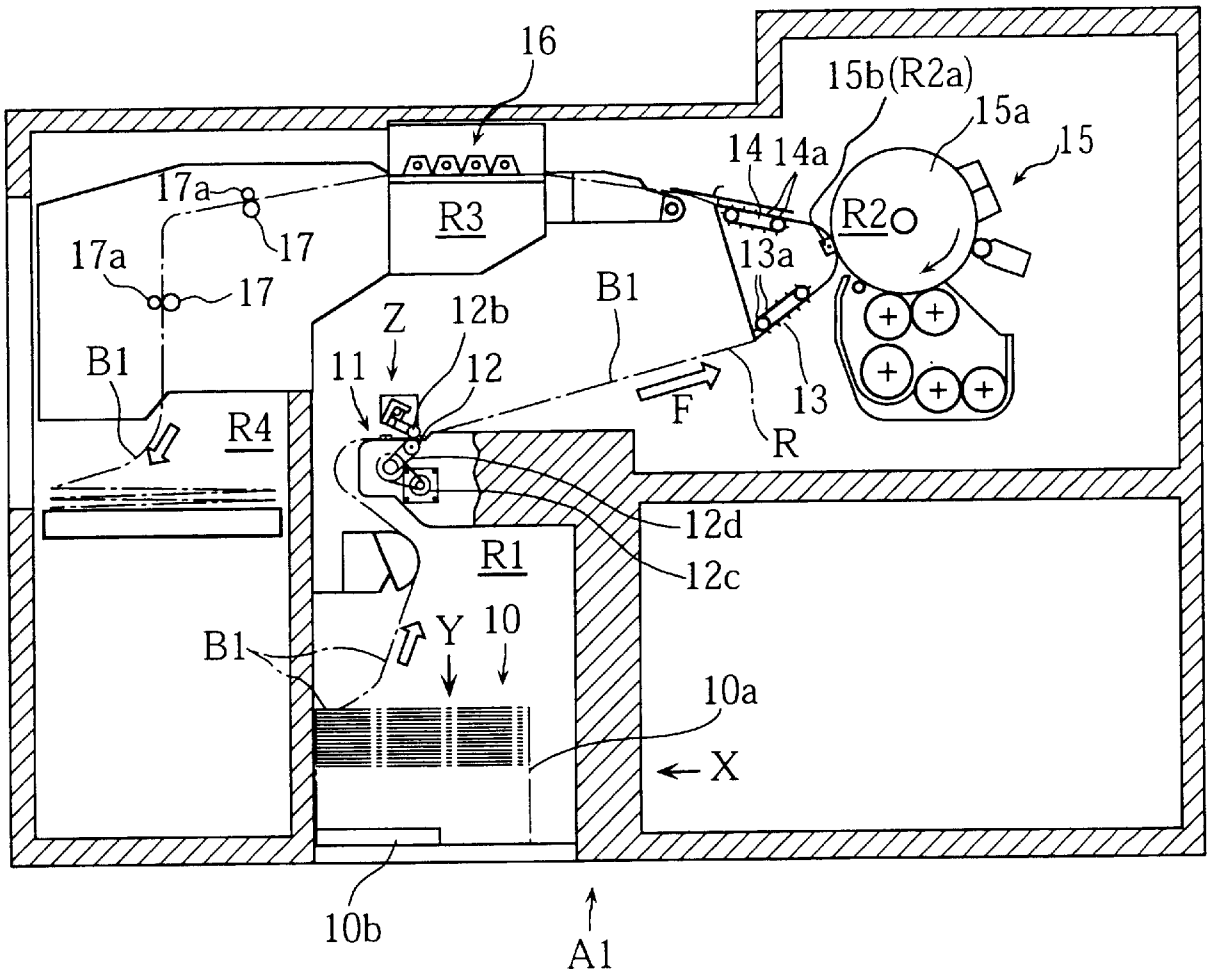
FIG. 1 illustrates an electrophotographic device incorporating a paper transfer apparatus embodying the present invention.

Reference is first made to FIG. 1 showing an electrophotographic device incorporating a paper transfer apparatus according to a first embodiment of the present invention. The illustrated apparatus A1 may be a photocopier for example. The incorporated paper transfer apparatus is provided for transferring recording paper which is designated by reference B1.

Figure 2:
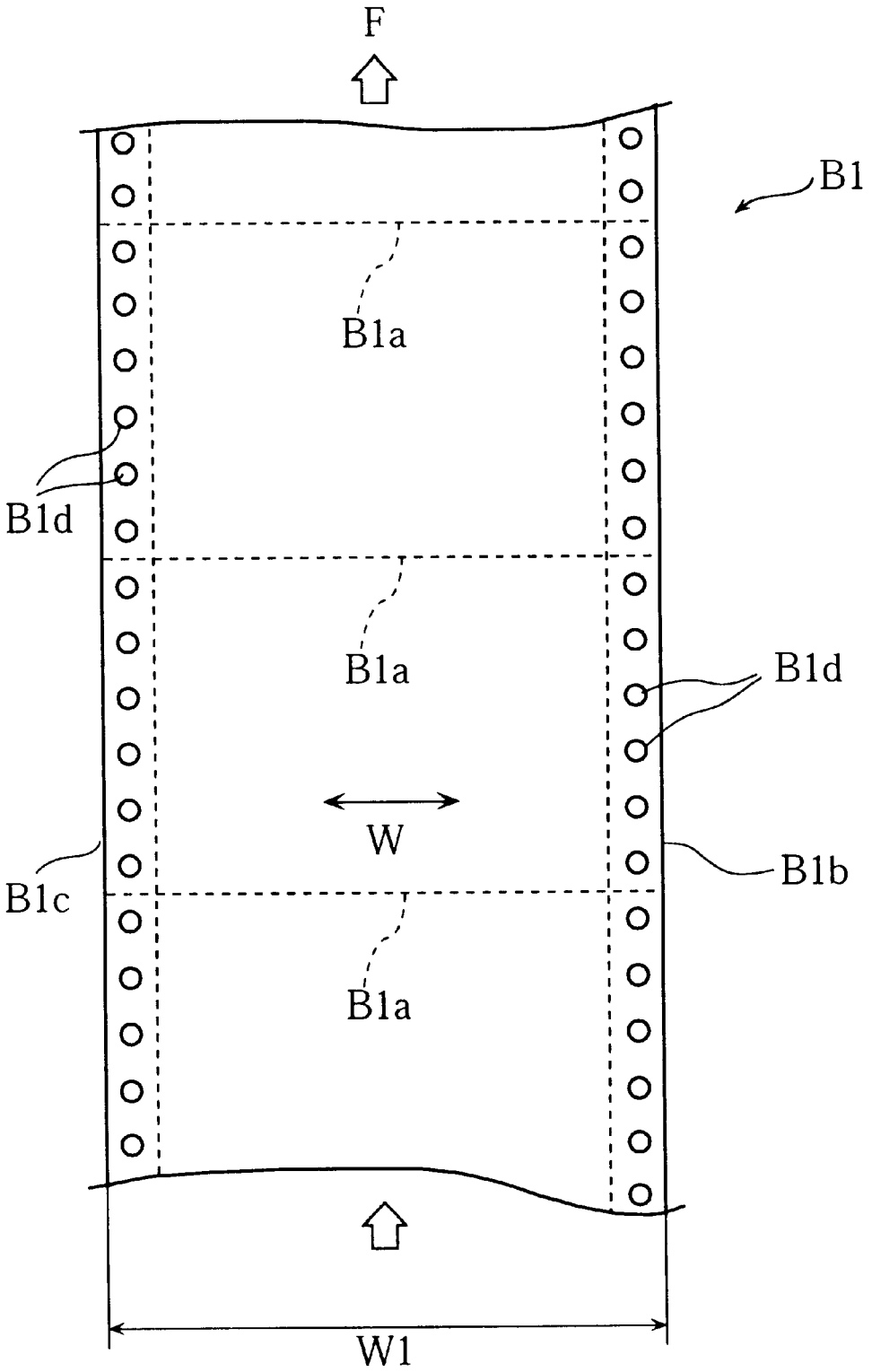
FIG. 2 is a plan view showing elongated paper used for the electrophotographic device of FIG. 1.

As shown in FIG. 2, the recording paper B1 is an elongated strip made of a series of continuous recording segments each defined by adjacent lines of perforations B1*a*. Each line of perforations extends in a widthwise direction W of the recording paper B1. The respective lines of perforations are spaced from each other at constant intervals longitudinally of the recording paper B1 (or in a feeding direction F of the recording paper, which is perpendicular to the widthwise direction W). The recording paper B1 has two longitudinal edges B1*b* and B1*c*, and is formed with a plurality of feed holes B1*d* arranged along the respective longitudinal edges B1*b* and B1*c*. The feed holes B1*d* arranged along each longitudinal edge are spaced from each other at constant intervals in the feeding direction F. The width of the recording paper B1 is designated by reference W1.

Referring back to FIG. 1, a transfer path R along which the recording paper B1 is transferred extends within the apparatus A1. As is shown, the transfer path R begins at a paper feeding section R1, and passes through an image transfer section R2, an image fixing section R3, and finally terminates at a paper stacking section R4. For ensuring proper transfer of the recording paper B1, the apparatus A1 is provided with a first transfer assisting mechanism 10, a second transfer assisting mechanism 11, a feed roller 12, a first and a second traction mechanisms 13, 14, and two discharge rollers 17. For performing image transfer at the section R2, the apparatus A1 is provided with an image processing unit 15. As can be easily understood from the figure, toner-developed images produced on a cylindrical side surface 15*b* of a photosensitive drum 15*a* are transferred onto the recording paper B1 at the image transfer section R2. Further, for performing fixation of toner images at the section R3, the apparatus A1 is provided with an image fixing unit 16 serving to subject the toner images on the recording paper B1 to thermal treatment. Though not shown in FIG. 1, use is also made of a plurality of paper guide plates arranged at predetermined locations along the transfer path R, so that the recording paper B1 is properly guided along the transfer path R.

The arrangements and functions of the feed roller 12, the first and second traction mechanisms 13–14, the image processing unit 15, the fixing unit 16 and the discharge rollers 17 are well known. Thus, hereinafter, only a brief description will be made to those elements.

Figure 3:
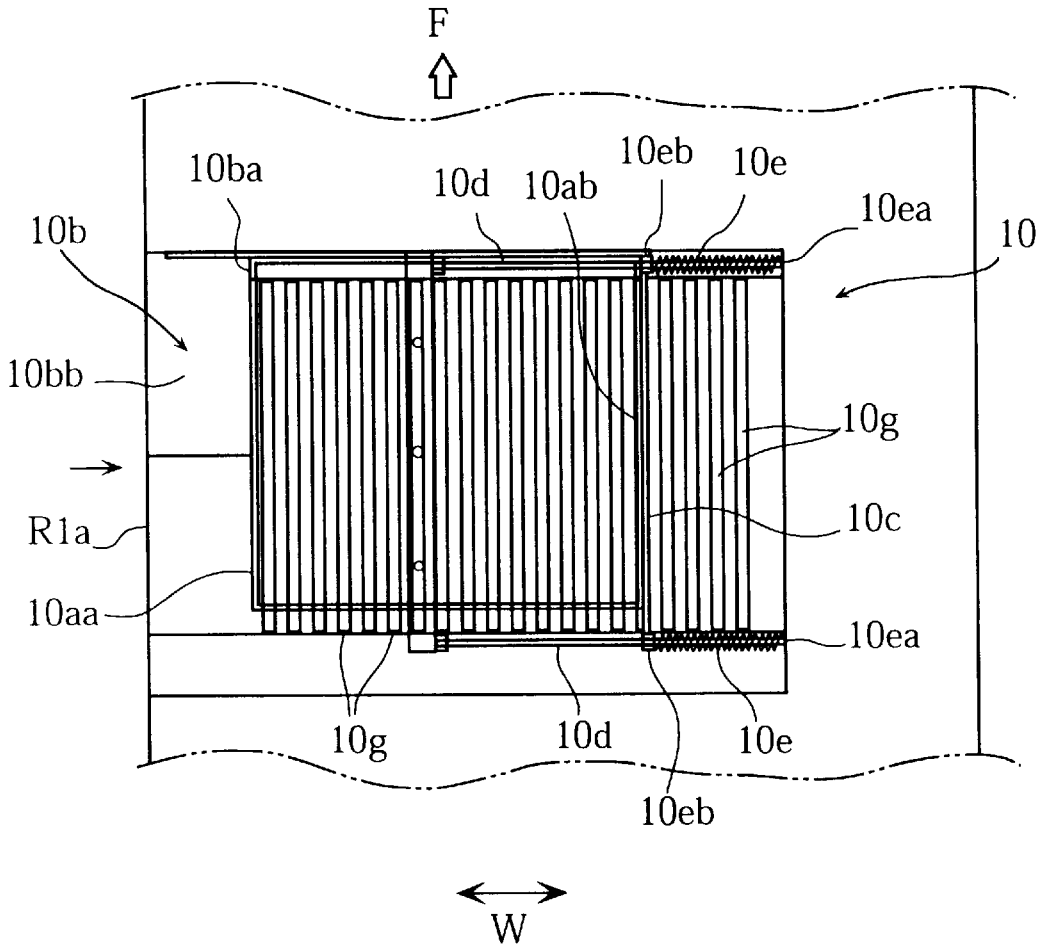
FIG. 3 is a plan view showing a paper transfer assisting mechanism as seen in a Y-direction in FIG. 1.
Figure 4:
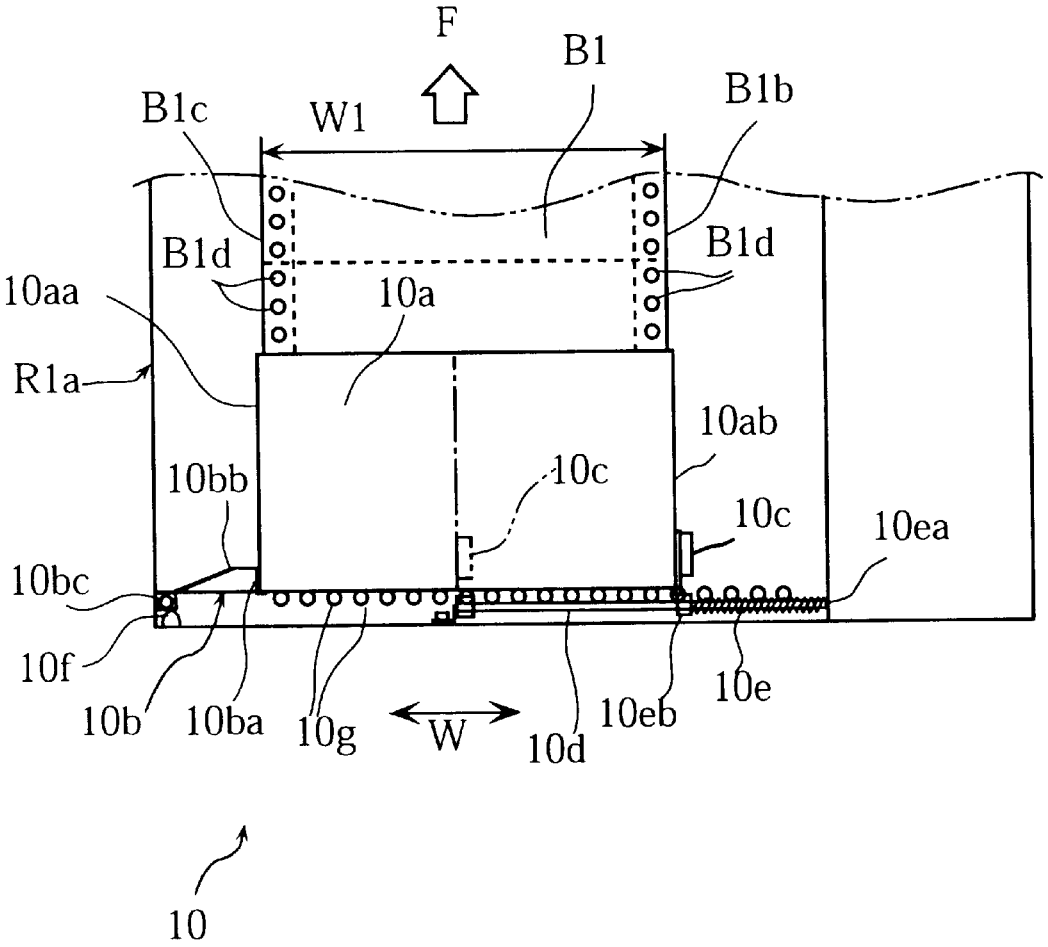
FIG. 4 is a side view showing the same paper transfer assisting mechanism as seen in an X-direction in FIG. 1.

Reference is now made to FIGS. 3 and 4. FIG. 3 is a plan view (as seen in a Y-direction in FIG. 1) showing the first transfer assisting mechanism 10, whereas FIG. 4 is a side view (as seen in an X-direction in FIG. 1) of the same mechanism. As will be described hereinafter, the first transfer assisting mechanism 10 is provided for maintaining a proper transferring posture of the recording paper B1 when the paper is fed from the feeding section RI onto the transfer path R. The first transfer assisting mechanism 10 includes a box-like paper container 10*a* for stacking the recording paper B1 in a neatly folded manner, a stationary positioning member 10*b*, a movable positioning member 10*c*, a pair of slide rails 10*d*, two compression springs 10*e*, and a suitable number of support rollers 10*g*.

The paper container 10*a* is upwardly open so that the elongated recording paper B1 is smoothly paid out from the container. The paper container 10*a* includes a pair of side walls 10*aa* and 10*ab* which are parallel to each other and spaced by a distance equal to (or slightly greater than) the width W1 of the recording paper B1. The paper container lOa is placed on the support rollers 10*g*. The support rollers 10*g*, which are rotatable about their axes, are equally spaced from each other in the widthwise direction W of the recording paper B1, as shown in FIGS. 3 and 4. (In FIG. 3, the bottom surface of the paper container 10*a* and the recording paper B1 are omitted for clarity of illustration.)

The stationary positioning member 10*b* is arranged adjacent to an opening R1*a* through which the paper container 10*a* is brought into or taken out of the paper feeding section R1. The positioning member 10*b* includes a side surface 10*ba* to come into contact with the side wall 10*aa* of the paper container 10*a*. The positioning member 10*b* also includes an inclined upper surface 10*bb*. As viewed in the widthwise direction W, the upper surface 10*bb* increases in height as it is getting farther from the opening R1*a*. The positioning member 10*b* is pivotably supported by a shaft at an edge 10*bc* opposite to the side surface 10*ba*. In a normal state, the positioning member 10*b* is held in the horizontal position shown in FIG. 4 under a counterclockwise urging force applied by a torsion coil spring 10*f*. However, when the paper container 10*a* is inserted into the paper feeding section R1 via the opening R1*a*, the positioning member 10*b* is caused to pivot clockwise and held down under the weight of the paper container 10*a*. Thereafter, when the paper container 10*a* is settled into place, the positioning member 10*b* returns to its initial position shown in FIG. 4.

The movable positioning member 10*c* is arranged to come into contact with the other side wall 10*ab* of the paper container 10*a*. To this end, use is made of the following arrangements. Specifically, the movable positioning member 10*c* is slidably supported at its both ends by the slide rails 10*d*. Each of the slide rails externally carries a respective one of the compression springs 10*e*. Each compression spring has a first end 10*ea* fixed relative to the apparatus A1 and a second end 10*eb* connected to the movable positioning member 10*c*. With such an arrangement, the movable positioning member 10*c* is constantly urged toward the stationary positioning member 10*b*. Thus, the movable positioning member 10*c* is always held in contact with the paper container 10*a*.

Figure 5:
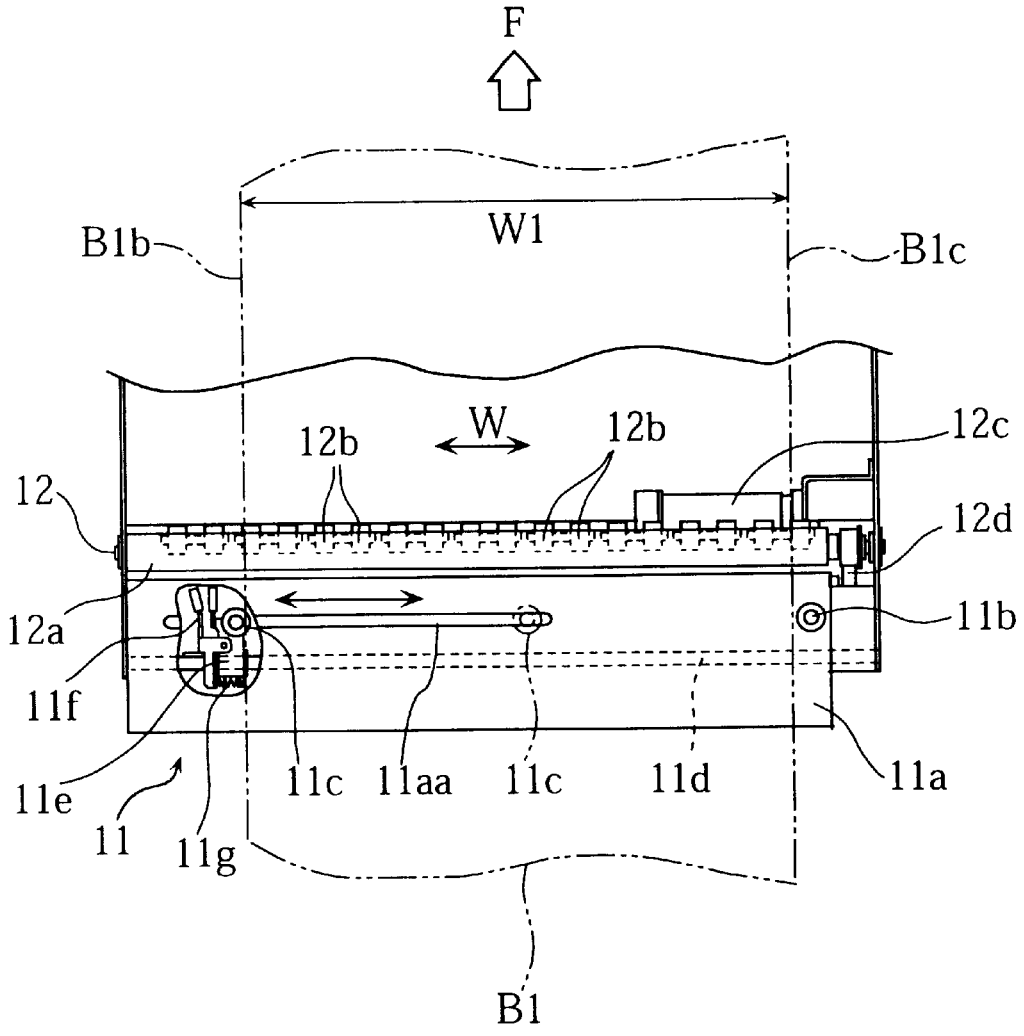
FIG. 5 is a plan view showing another paper transfer assisting mechanism and a paper feed roller as seen from a Z-direction in FIG. 1.
Figure 6:
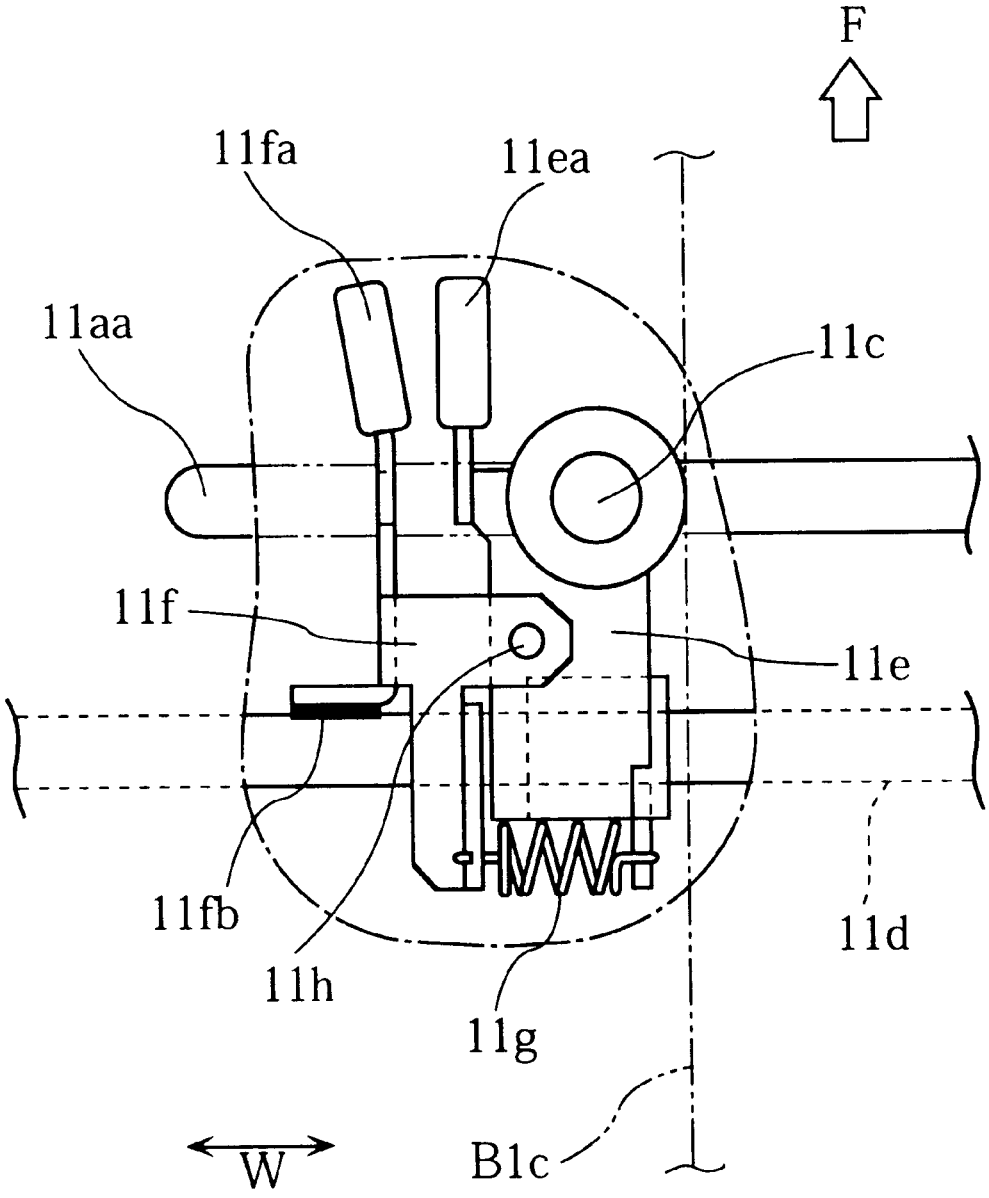
FIG. 6 is an enlarged plan view illustrating principal parts shown in FIG. 5.

Reference is now made to FIGS. 5 and 6. FIG. 5 is a plan view (as seen in a Z-direction in FIG. 1) showing the second transfer assisting mechanism 11 and the feed roller 12, whereas FIG. 6 is an enlarged view showing a cutaway portion in FIG. 5.

As can be seen from FIGS. 5 and 6, the second transfer assisting mechanism 11 is arranged at a position spaced backwardly (namely, in the direction opposite to the feeding direction F) from the feed roller 12. Like the first transfer assisting mechanism, the second transfer assisting mechanism 11 is provided for maintaining the proper transferring posture of the recording paper B1. To this end, the second transfer assisting mechanism 11 is arranged as follows.

The second transfer assisting mechanism 11 includes a paper guide plate 11*a*, a stationary guide roller 11*b*, a movable guide roller 11*c*, a guide rod 11*d*, first and second carriages 11*e*, 11*f*, and a spring 11*g*.

The paper guide plate 11*a* is provided for properly guiding the recording paper B1 along the transfer path. The paper guide plate 11*a* may be made of a metal or resin material. As is seen from FIG. 5, the paper guide plate is made into a generally rectangular form having a width greater than the width W1 of the recording paper B1. As shown in FIG. 5, the paper guide plate 11*a* is formed with an elongated slit 11*aa* extending in the widthwise direction W for allowing the guide roller 11*c* to move in the widthwise direction W.

The stationary guide roller lib may be a metal bearing and is rotatably supported by a shaft projecting from the paper guide plate 11*a*. As shown in FIG. 5, the guide roller 11*b* is arranged close to the right side edge of the paper guide plate 11*a* so that it comes into contact with the longitudinal edge B1*c* of the recording paper B1.

The movable guide roller 11*c* may also be a metal bearing and is arranged to the left of the stationary guide roller 11*b*. As is easily understood, the movable guide roller 11*c* will come into contact with the left side edge B1*b* of the recording paper B1. Behind the paper guide plate 11*a*, the guide rod lid extends in the widthwise direction W. The guide rod lid slidably supports the first and second carriages lie, 11*f*. As best shown in FIG. 6, the second carriage 11*f* is pivotably supported by the first carriage 11*e* via a shaft 11*h* projecting from the first carriage. At their extremities, the first and the second carriages 11*e*, 11*f* are connected to each other by the spring 11*g*. This spring is provided for causing the extremities of the respective carriages 11*e*, 11*f* to come closer to each other. On the opposite side, the first carriage 11*e* is provided with an operation lever 11*ea*, while the second carriage 11*f* is provided with an operation lever 11*fa*. The second carriage 11*f* is also provided with a rubber stopper 11*fb* coming into contact with the guide rod 11*d*. Because of the rubber stopper 11*fb*, the first and second carriages are properly fixed at a desired position along the guide rod 11*d*. When the user squeezes the operation levers 11*ea*, 11*fa*, causing the two levers to approach each other, the second carriage 11*f* pivots clockwise about the shaft 11*h*. As a result, the rubber stopper 11*fb* is removed away from the guide rod 11*d*, thereby enabling the first and second carriages to be freely moved along the guide rod 11*d*. The movable guide roller 11*c* is carried by the first carriage 11*e* thus arranged.

Referring back to FIGS. 1 and 5, the feed roller 12 is arranged adjacent to the paper feeding section R1, so that the recording paper B1 is properly fed from the feeding section R1. As best shown in FIG. 5, the feed roller 12 has a length greater than the width W1 of the recording paper B1. The cylindrical surface 12*a* of the feed roller 12 slightly protrudes beyond the paper guide plate 11*a*, so that the surface 12*a* can come into contact with the recording paper B1. Preferably, the surface 12*a* of the feed roller 12 is made of an elastic material such as silicone rubber for generating sufficient traction between the recording paper B1 and the feed roller 12. As shown in broken lines in FIG. 5, a plurality of pinch rollers 12*b* are held in contact with the surface 12*a* of the feed roller 12. The pinch rollers 12*b* are spaced from each other at predetermined intervals in the widthwise direction W. The illustrated feed roller 12 is driven by a driving motor 12*c* via a suitable belt 12*d*. When the feed roller 12 is rotated, the pinch rollers 12*b* held in contact with the feed roller 12 are also rotated. In operation, the recording paper B1 is held between the rotating feed roller 12 and the pinch rollers 12*b*. In this condition, the recording paper B1 is forwarded in the feeding direction F. It is possible to move the pinch rollers 12*b* away from the surface 12*a* of the feed roller 12. Thus, the user can easily place the recording paper B1 between the feed roller 12 and the pinch rollers 12*b*.

The first and the second traction mechanisms 13, 14 (see FIG. 1) are provided with engaging claws 13*a* and 14*a* which are brought into engagement with the feed holes B1*d* (see FIG. 2). The engaging claws 13*a*, 14*a*, spaced from each other at the same intervals as those of the feed holes B1*d*, are formed on endless belts. Thus, when the endless belts are driven, the recording paper B1 is advanced, with the moving claws 13*a*, 14*a* engaged with the feed holes B1*d*. Though not shown in FIG. 1, each of the traction mechanisms 13, 14 includes two endless belts each formed with engaging claws. As viewed along the transfer path R, the first traction mechanism 13 is located before the image transfer section R2, whereas the second traction mechanism 14 is located after the section R2. With such an arrangement, both of the longitudinal edges of the recording paper B1 are properly positioned by the first and the second traction mechanisms. Of course, each of the traction mechanisms is adjustable in widthwise dimension so that it can cope with various kinds of recording papers having different widths.

In operation, the driving rate of the endless belts of the first traction mechanism 13 and the rotating rate of the feed roller 12 are adjusted so that the recording paper B1 is forwarded properly (without sagging for example) from the feed roller 12 to the first traction mechanism 13.

The image processing unit 15, as previously stated, is provided for transferring toner images formed on the photosensitive drum 15*a* onto the recording paper B1 at the image transfer section R2. In addition to the photosensitive drum 15*a*, the image processing unit 15 includes a transfer device 15*b* and other peripheral devices. At the location of the transfer device 15*b* (image transfer point R2*a*), the toner images formed on the drum 15*a* are transferred onto the recording paper B1.

The fixing unit 16 at the image fixing section R3 is arranged between the image transfer section R2 and the paper stacking section R4. As previously stated, the fixing unit 16 subjects the toner images transferred onto the recording paper B1 to thermal treatment for fixation of the tone images.

The discharge rollers 17 are arranged between the image fixing section R3 and the paper stacking section R4. In arrangement, the discharge rollers 17 are similar to the feed roller 12. A plurality of pinch rollers 17*a* are held in contact with the discharge rollers 17. The recording paper B1 brought into the stacking section R4 is accommodated therein in a neatly folded manner.

Next, description is made to the operation of the electrophotographic apparatus A1 having the arrangements stated hereinbefore.

First, the paper container 10*a* holding elongated recording paper B1 is to be brought into place at the paper feeding section R1. As shown in FIG. 4, the paper container 10*a* is smoothly settled into the feeding section R1, since the container is advantageously moved over the support rollers 10*g*. While the paper container 10*a* is being put into place, the stationary positioning member 10*b* is held down (caused to pivot clockwise about the shaft 10*bc*) under the weight of the paper container 10*a*, as previously stated.

As the paper container 10*a* is moved further into the feeding section R1, the side wall 10*ab* of the container 10*a* comes into contact with the movable positioning member 10*c*, pushing it to the right (away from the opening R1*a*) against the urging force of the springs 10*e*.

When the paper container 10*a* is completely brought into place, the stationary positioning member 10*b* will return to the initial position from the temporarily held down position. In this state, the paper container 10*a* is fixed between the two positioning members 10*b*, 10*c*. In this manner, it is possible to prevent the paper container 10*a* from being unduly displaced in the widthwise direction W at the paper feeding section R1, thereby preventing lateral displacement of the longitudinal edges B1*b*, B1*c* of the recording paper B1.

After the paper container 10*a* is properly set in the paper feeding section R1, the free end portion of the recording paper B1 may be manually brought out of the container 10*a*, so that a suitable length of the paper B1 is paid out, extending along the transfer path R. Then, the feed holes B1*d* of the recording paper are brought into engagement with the claws 13*a*, 14*a* of the first and second traction mechanisms 13, 14.

Thereafter, the movable guide roller 11*c* is adjusted in position, so that the guide roller 11*c* comes into contact with the longitudinal edge B1*b* of the recording paper B1. While this adjustment being performed, the stationary guide member 11*b* is held in contact with the other longitudinal edge B1*c*. With the recording paper B1 flanked by the two guide rollers 11*b*, 11*c*, the recording paper will be properly transferred, for example without deviating from the transfer path R.

Upon completion of the initial settings described above, the feed roller 12 and the first and second traction mechanisms 13, 14 will be actuated. Then, more of the recording paper B1 is automatically paid out from the paper container 10*a* by the feed roller 12. It should be noted that, as stated above, the lateral (widthwise) deviation of the recording paper B1 is advantageously prevented not only by the side walls 10*aa*, 10*ab* of the paper container 10*a* but by the guide rollers 10*b*, 10*c* as well. Thus, according to the present invention, the recording paper B1 is properly fed from the paper container 10*a* and sent into the transfer path R.

Further, as previously stated, the stationary guide roller 11*b* and the movable guide roller 11*c* are rotatably supported. Thus, the two guide rollers 11*b*, 11*c* will be rotated upon contact with the recording paper B1 transferred along the transfer path R. This means that the guide rollers 11*b*, 11*c* are prevented from being worn out by the recording paper B1 which may be transferred at high speed (1,000 mm/s for example).

Still further, at the image transfer section R2, positional deviation of the recording paper B1 is prevented by the engagement of the feed holes B1*d* of the recording paper with the claws 13*a*, 14*a* of the first and second traction mechanisms 13, 14.

Therefore, according to the present invention, the recording paper B1 is properly transferred from the feeding section R1 along the transfer path R to be brought to the image fixing section R3. In other words, the recording paper B1 will not sway widthwise or unduly be brought into an oblique posture, either. As a result, unfavorable vibrations which may adversely affect the image-transferring performance at the transfer section R2 will not be generated.

Further, with the use of the movable guide roller 11*c* and the movable positioning member 10*c* both of which are adjustable in position, the illustrated apparatus A1 is capable of coping with various kinds of recording papers having different widths.

Figure 7:
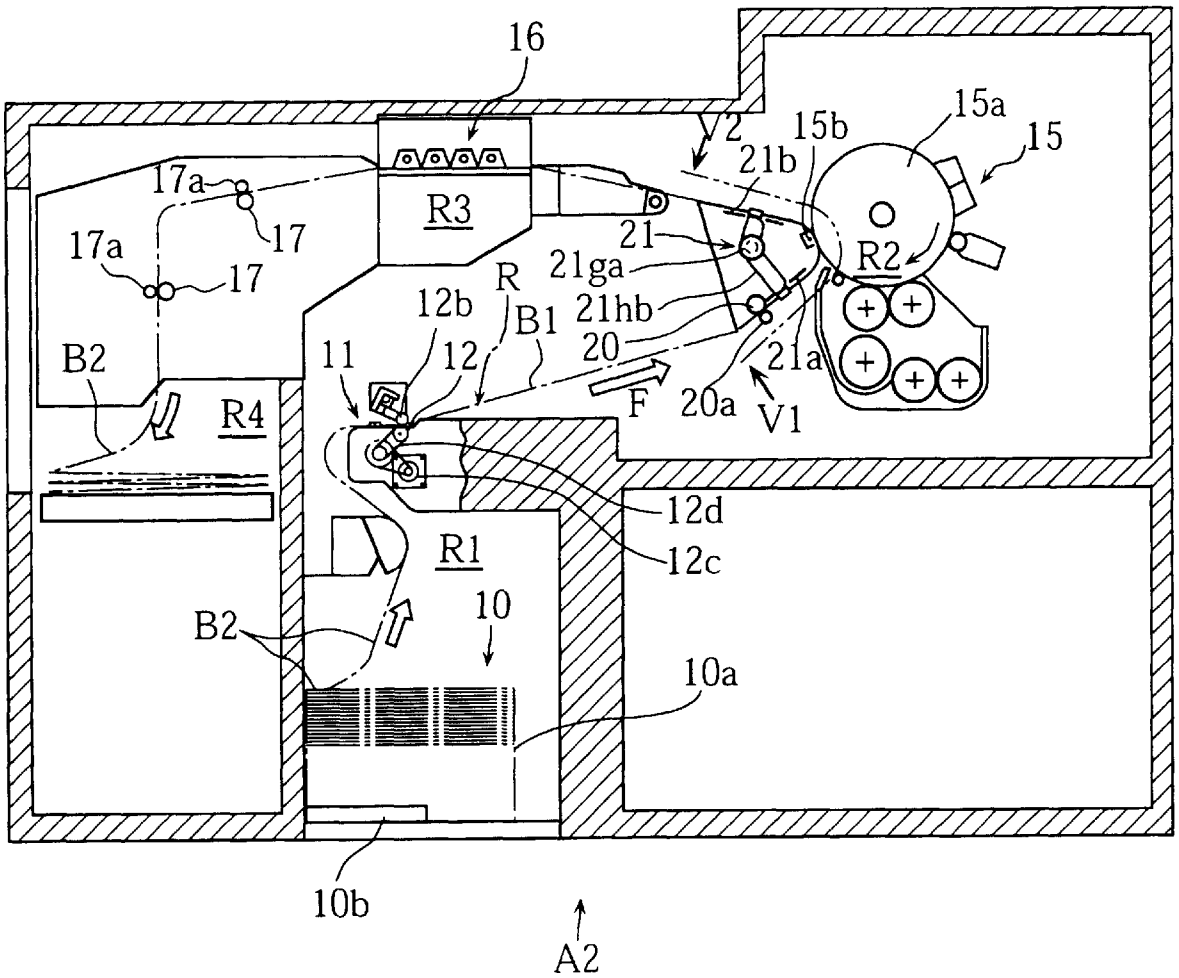
FIG. 7 illustrates an electrophotographic device incorporating another type of paper transfer apparatus embodying the present invention.

Referring to FIG. 7, description is now made to an electrophotographic apparatus according to a second embodiment of the present invention. As can be seen from the figure, the apparatus A2 of the second embodiment is basically similar to the apparatus A1 of the first embodiment. Thus, elements and members of the second embodiment which are identical or similar to those of the first embodiment may be indicated by the same reference numerals or characters.

Figure 8:
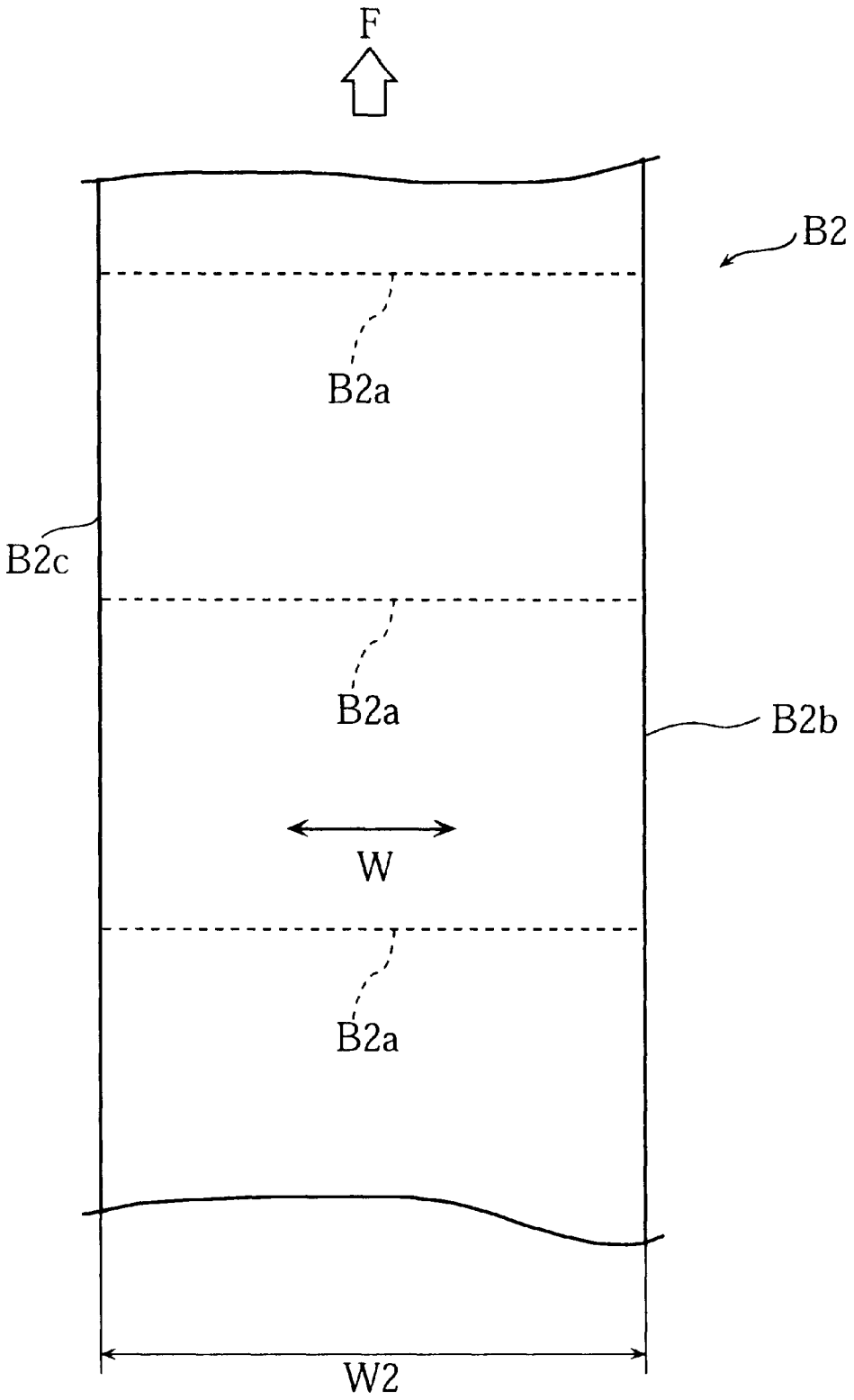
FIG. 8 is a plan view showing elongated paper used for the electrophotographic device of FIG. 7.

Referring to FIG. 8, a recording paper B2 with no feed holes is utilized for the apparatus A2. The illustrated paper B2 is formed with plural lines of perforations B2*a* each extending in the widthwise direction W.

The most important features of the apparatus A2 are a transfer roller 20 arranged adjacent to an image transfer section R2, and a third transfer assisting mechanism 21.

Figure 9:
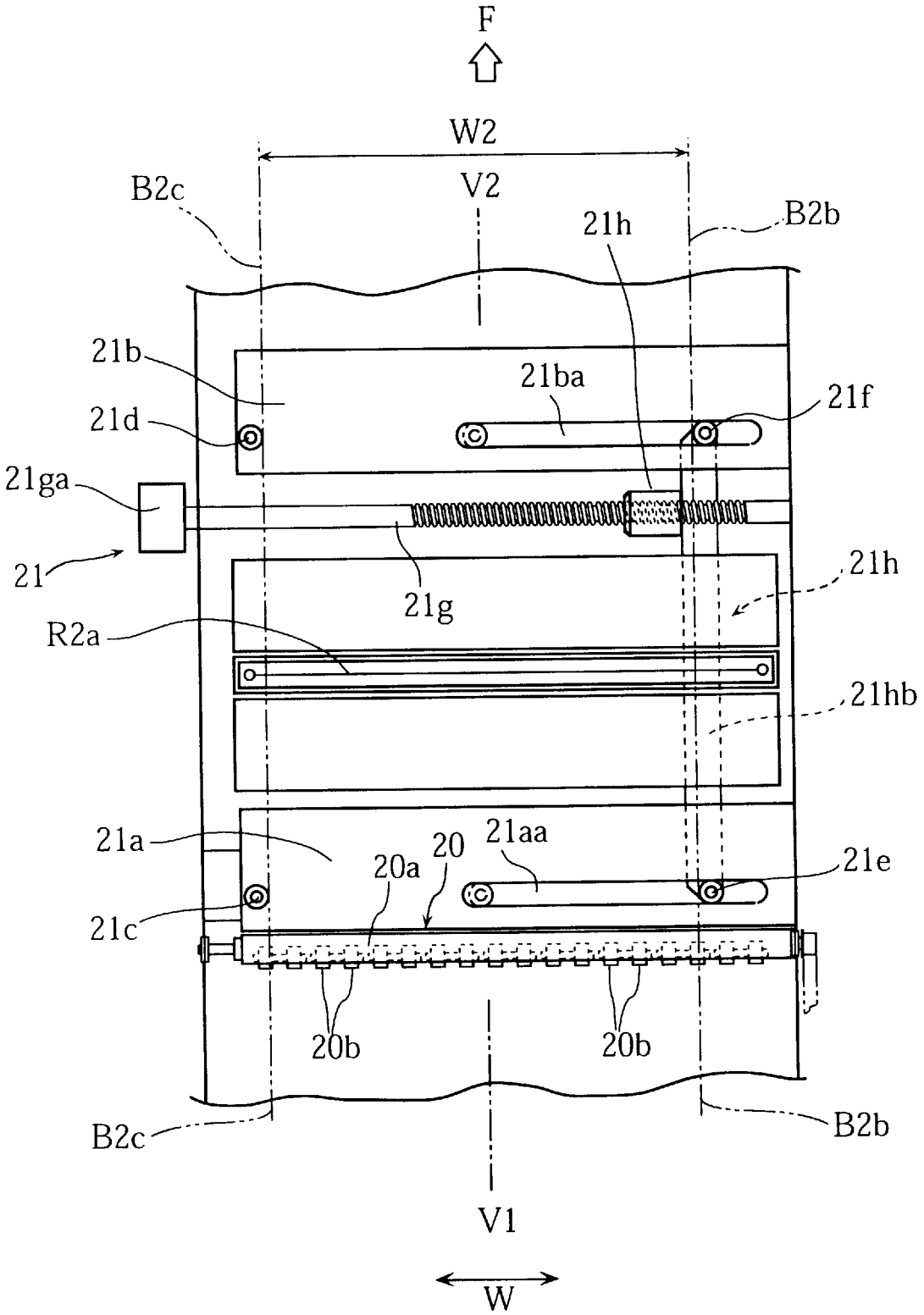
FIG. 9 illustrates arrangements adjacent to an image transfer section, as seen from a double-dot chain line extending from a point V1 to a point V2 in FIG. 7.

FIG. 9 illustrates the third transfer assisting mechanism 21 and other elements, as viewed from the double-dot chain line extending from a point V1 to a point V2. As can be seen from the figure, the transfer roller 20 is similar in arrangement to the paper feed roller 12 described hereinbefore. As viewed along the transfer path R, the transfer roller 20 is spaced slightly backward from the third transfer assisting mechanism 21. The transfer roller 20, which serves to advance the recording paper B2 to the image transfer section R2, has a cylindrical side surface 20*a* which a plurality of pinch rollers 20*b* are held in contact with. The pinch rollers 20*b* are spaced from each other at predetermined intervals in the widthwise direction W. Thus, when the transfer roller 20 rotates, the pinch rollers 20*b* are rotated by the transfer roller. In operation, while being held between the transfer roller 20 and the pinch rollers 20*b*, the recording paper B2 is advanced by the transfer roller 20. The pinch rollers 20*b* are arranged to shift away from the transfer roller 20. Thus, with the pinch rollers 20*b* held in a position spaced from the transfer roller 20, the user can easily place the recording paper B2 between the transfer roller 20 and the pinch rollers 20*b*.

The third transfer assisting mechanism 21 is provided for preventing the positional deviation of the recording paper B2 transferred along the path R. As shown in FIG. 9, the third transfer assisting mechanism 21 includes a first and a second paper guide plates 21*a*–21*b*, first and second stationary guide rollers 21*c*–21*d*, first and second movable guide rollers 21*e*–21*f*, an externally threaded rod 21*g*, and an internally threaded member 21*h*.

As viewed along the transfer path R, the first paper guide plate 21*a* is spaced slightly backward from a transfer point R2*a* in the image transfer section R2, whereas the second paper guide plate 21*b* is spaced slightly forward from the transfer point. The first paper guide plate 21*a* is formed with an elongated slit 21*aa* extending in the widthwise direction W, whereas the second paper guide plate 21*b* is formed with an elongated slit 21*ba* extending in parallel to the above-mentioned slit 21*aa*. As will be described in detail hereinafter, the first movable guide roller 21*e* can be shifted in position along the slit 21*aa*, while the second movable guide roller 21*f* can be shifted in position along the slit 21*ba*.

The first and the second stationary guide rollers 21*c*, 21*d* are similar in arrangement to the stationary guide roller 11*b* of the first embodiment. As shown in FIG. 9, the two guide rollers 21*c*, 21*d* are arranged close to the left edges of the guide plates 21*a*, 21*b*, respectively. With such an arrangement, the guide rollers 21*c*, 21*d* will come into contact with the longitudinal edge B2*c* of the recording paper B2. The guide rollers 21*c*, 21*d* are rotatably supported by a shaft fixed to the first paper guide plate 21*a* or the second paper guide plate 21*b*.

The first and the second movable guide rollers 21*e*, 21*f* are arranged to the right of the first and the second stationary guide rollers 21*c*, 21*d*, respectively. The movable guide rollers 21*e*, 21*f* are adjustable in position so that they are properly brought into contact with the longitudinal edge B2*b* of the recording paper B2. Each of the guide rollers 21*e*, 21*f* is rotatably supported by a shaft.

As best shown in FIG. 7, the externally threaded rod 21*g* is arranged between the first and second paper guide plates 21*a*, 21*b*. The rod 21*g*, as shown in FIG. 9, supports the internally threaded member 21*h* screwed onto the rod. The rod 21*g* is provided with a knob 21*ga* fixed to an end of the rod. With such an arrangement, the user can easily rotate the rod 21*g* relative to the internally threaded member 21*h*. As can be easily understood, when the rod 21*g* is rotated, the internally threaded member 21*h* is caused to move longitudinally of the rod 21*g* (in the widthwise direction W). The internally threaded member 21*h* is fixed to an elongated arm member 21*hb*. The arm member 21*hb* carries the first movable guide roller 21*e* at one end thereof, while also carrying the second movable guide roller 21*f* at the opposite end.

With such an arrangement, by rotating the rod 21*g* about its axis in one direction or the other via the knob 21*ga*, it is possible to positionally shift the internally threaded member 21*h* and the arm member 21*hb* in the widthwise direction W. Further, once the internally threaded member 21*h* is stopped at a selected position, the threaded member 21*h* (and the arm member 21*hb*) will not be unduly displaced from that position until the user operates the knob 21*ga* again. In this manner, the user can easily perform the positioning of the movable guide rollers 21*e*, 21*f* with respect to the longitudinal edge B2*b* of the recording paper B2.

As described above, in the second embodiment, the recording paper B2 at the image transfer section R2 is properly guided along the transfer path R thanks to the stationary guide rollers 21*c*, 21*d* and the movable guide rollers 21*e*, 21*f*.

The preferred embodiments of the present invention being thus described, it is obvious that the same may be varied in various ways. Such variations should not be regarded as a departure from the spirit and scope of the invention, and all such variations as would be obvious to those skilled in the art are intended to be included within the scope of the appended claims.

What is claimed is:

1. A paper transfer assisting mechanism for ensuring proper transfer of elongated paper moved along a transfer path, the elongated paper having a first longitudinal edge and a second longitudinal edge, the mechanism comprising:

a paper guide plate arranged adjacent to the transfer path;

a first rotatable guide roller brought into contact with the first longitudinal edge of the paper; and a second rotatable guide roller brought into contact with the second longitudinal edge of the paper;

wherein the first rotatable guide roller is immovable on the paper guide plate, and the second rotatable guide roller is movable toward and away from the first rotatable guide roller.

2. The paper transfer assisting mechanism according to claim 1, further comprising: a guide rod extending transversely of the transfer path; and a carriage slidably supported by the guide rod;

wherein the second guide roller is supported by the carriage.

3. The paper transfer assisting mechanism according to claim 2, further comprising a spring connected to the carriage, wherein the carriage is releasably fixed in position to the guide rod by an urging force of the spring.

4. The paper transfer assisting mechanism according to claim 1, further comprising: an externally threaded rod extending transversely of the transfer path; and an internally threaded member screwed on the externally threaded rod; wherein the second guide roller is connected to the internally threaded member.

5. The paper transfer assisting mechanism according to claim 1, further comprising a third rotatable guide roller brought into contact with the first longitudinal edge of the paper and a fourth rotatable guide roller brought into contact with the second longitudinal edge of the paper, wherein the third guide roller is spaced from the first guide roller along the transfer path, the fourth guide roller being spaced from the second guide roller along the transfer path.

6. A paper transfer assisting mechanism for ensuring proper transfer of elongated paper moved along a transfer path extending from a paper feeding section, the elongated paper having a first longitudinal edge and a second longitudinal edge, the mechanism comprising:

a paper container placed at the paper feeding section for holding the paper, the paper container being provided with a first side wall and a second side wall facing the first side wall, a distance between the first and the second side walls being substantially equal to a distance between the first and second longitudinal edges of the paper;

a first positioning member coming into contact with the first side wall of the paper container; and a second positioning member coming into contact with the second side wall of the paper container;

wherein the first positioning member is fixed in position, and the second positioning member is adjustable in position with respect to the first positioning member.

7. The paper transfer assisting mechanism according to claim 6, further comprising a slide rail for slidably supporting the second positioning member, and a spring associated with the slide rail for urging the second positioning member toward the first positioning member.

8. The paper transfer assisting mechanism according to claim 6, wherein the first positioning member is variable in posture.

9. The paper transfer assisting mechanism according to claim 6, further comprising a plurality of rotatable support rollers arranged at the paper feeding section for supporting the paper container, wherein the paper container comprises a box.

10. A paper transfer apparatus for transferring elongated paper provided with feed holes, the paper being transferred along a transfer path extending from a paper feeding section to a terminal section via a processing section, the paper transfer apparatus comprising:

a traction mechanism for transferring the paper along the transfer path, the traction mechanism being arranged at a predetermined location adjacent to the transfer path and provided with engaging claws coming into engagement with the feed holes of the paper;

a paper feed roller for feeding the paper from the paper feeding section, the paper feed roller being spaced from the traction mechanism along the transfer path toward the paper feeding section; and a paper transfer assisting mechanism arranged adjacent to the paper feed roller for ensuring proper transfer of the paper;

wherein the paper has a first longitudinal edge and a second longitudinal edge, the paper transfer assisting mechanism comprising: a paper guide plate arranged adjacent to the transfer path; a first rotatable guide roller brought into contact with the first longitudinal edge of the paper;

and a second rotatable guide roller brought into contact with the second longitudinal edge of the paper, the first rotatable guide roller being immovable on the paper guide plate, and the second rotatable guide roller being movable toward and away from the first rotatable guide roller.

11. The paper transfer apparatus according to claim 10, wherein the traction mechanism is arranged adjacent to the processing section.

12. The paper transfer apparatus according to claim 10, further comprising: a paper container placed at the paper feeding section for holding the paper, the paper container being provided with a first side wall and a second side wall facing the first side wall, a distance between the first and the second side walls being substantially equal to a distance between the first and second longitudinal edges of the paper; a first positioning member coming into contact with the first side wall of the paper container; and a second positioning member coming into contact with the second side wall of the paper container.

13. The paper transfer apparatus according to claim 10, wherein the paper is subjected to image transfer processing at the processing section.

14. A paper transfer apparatus for transferring elongated paper along a transfer path extending from a paper feeding section to a terminal section via a processing section, the paper transfer apparatus comprising:

a paper feed roller for feeding the paper from the paper feeding section;

a paper transfer roller for transferring the paper along the transfer path, the paper transfer roller being spaced from the paper feed roller along the transfer path toward the terminal section;

a first paper transfer assisting mechanism arranged adjacent to the paper feed roller; and a second paper transfer assisting mechanism arranged adjacent to the paper transfer roller;

wherein the paper has a first longitudinal edge and a second longitudinal edge, each of the first and second paper transfer assisting mechanism comprising: a paper guide plate arranged adjacent to the transfer path; a rotatable guide roller brought into contact with the first longitudinal edge of the paper; and another rotatable guide roller brought into contact with the second longitudinal edge of the paper, the first rotatable guide roller being immovable on the paper guide plate, and the second rotatable guide roller being movable toward and away from the first rotatable guide roller.

15. The paper transfer apparatus according to claim 14, further comprising an additional paper transfer assisting mechanism spaced from the processing section along the transfer path toward the terminal section, wherein the additional paper transfer assisting mechanism comprises a paper guide plate arranged adjacent to the transfer path, a first rotatable guide roller brought into contact with the first longitudinal edge of the paper and a second rotatable guide roller brought into contact with the second longitudinal edge of the paper.

* * * * *